United States Patent [19]

Bischeltsrieder

[11] 4,130,979

[45] Dec. 26, 1978

[54] SADDLE TREE FOR RIDING SADDLES

[75] Inventor: Lorenz Bischeltsrieder, Fürstenfeldbruck, Germany

[73] Assignee: Stübben GmbH, Riding Equipment, Stans, Switzerland

[21] Appl. No.: 761,010

[22] Filed: Jan. 21, 1977

Related U.S. Application Data

[63] Continuation-in-part of Ser. No. 555,194, Mar. 4, 1975, Pat. No. 4,004,402.

[51] Int. Cl.[2] ..... B68C 1/00

[52] U.S. Cl. ..... 54/44

[58] Field of Search ..... 54/44, 46, 37

[56] References Cited

U.S. PATENT DOCUMENTS

| | | | |
|---|---|---|---|
| 16,345 | 1/1857 | Ward | 54/44 |
| 1,610,989 | 12/1926 | Aguilar | 54/44 X |
| 3,323,286 | 6/1967 | Laurin, Jr. | 54/44 |

*Primary Examiner*—Hugh R. Chamblee

*Attorney, Agent, or Firm*—Strauch, Nolan, Neale, Nies & Kurz

[57] ABSTRACT

A saddle tree for riding saddles which is composed of a frame and a separate cantle plate. The tree has the properties of a conventional spring tree and can be more economically produced.

8 Claims, 5 Drawing Figures

SADDLE TREE FOR RIDING SADDLES

This application is a continuation-in-part of application Ser. No. 555,194 filed Mar. 4, 1975 (now U.S. Pat. No. 4,004,402 issued Jan. 25, 1977).

The present invention relates to improvements in plastic saddle trees for riding saddles. Saddle trees in accord with the present invention consist of a saddle tree frame member having depending, bow-like front arches or points which overlap the withers of the horse, a waist joined to said front arches, and a rear cantle, on which a separate cantle plate determining the length and width of the cantle is rested and attached.

The invention particularly concerns improvements in the saddle trees of application Ser. No. 555,194.

As already stated in application Ser. No. 555,194, the manufacture of saddle trees of the conventional type, whether of wood or spring steel bands or of plastic materials, is relatively costly. Even though the production of plastic saddle trees has reduced costs considerably, a relatively high cost factor still has to be taken into account due to the high cost of molds. The manufacture of plastic saddle trees is thus in principle only worthwhile in large numbers.

A reduction in mold costs was the aim of the proposal in application Ser. No. 555,194, this to be accomplished by providing a saddle tree frame suitable for various, different saddle sizes on which appropriate cantle plates of varying dimensions could be mounted.

Plastic saddle trees have up to now always had the disadvantage, resulting from their construction and the material used, that they do not bounce or yield to the desired and necessary extent when the rider is seated on the saddle. Hithereto, only riding saddles with conventional spring saddle trees have had the desired springy properties.

It is an object of this invention to create a saddle tree of a plastic material for riding saddles having properties equivalent to all the good properties of a conventionally mounted spring saddle tree. The riding saddle equipped with the saddle tree constructed according to the invention should furthermore lie as fully as possible on the horse's back, thus avoiding in particular pressure sores, as well as having an adequate amount of sringy give when the rider, by virtue of his own weight, is pressed more or less hard into the seat of the saddle during the different paces of the horse; and it is a further object to provide saddle trees with these properties. Finally, it is also an object of the invention to keep the production costs for the saddle tree, even in differing sizes, relatively low.

To solve this task it is proposed, according to the invention, in a further development of the subject matter of application Ser. No. 555,194, to construct the plastic saddle tree in such a way: that the cantle plate extends forwardly across about two-thirds of the length of a relatively firm, stable, and rigid saddle tree frame; that the cantle plate is relatively thin-walled, constructed of an elastic material, and rests with only its front peripheral area on the waist section and its rear, downwardly-inclined cantle plate edge on the rear edge of the cantle of the saddle tree frame; and that the cantle plate is preferably attached to the saddle tree frame member with an initial tension and with a flat space between the upper surface of the saddle tree frame under the cantle plate and the underside of the latter into which the cantle plate can yield or spring. A saddle tree constructed in this way combines all the advantages of known saddle trees. The rigidity of the saddle tree frame member ensures the desired support of the saddle on the horse's back, and the construction and arrangement of the cantle plate, which virtually extends across the seat of the saddle tree (and therefore of the saddle), guarantees the desired springy property. The construction furthermore renders economic production possible since only one uniform saddle tree frame is used for all saddle sizes; and only cantle plates of differing sizes need to be mounted on it to give the saddle tree the desired size as regards width and length. The cost of a mold for the saddle tree frame thus occur only once, along with mold costs for relatively simple molds for the different cantle plates.

Figure 3:
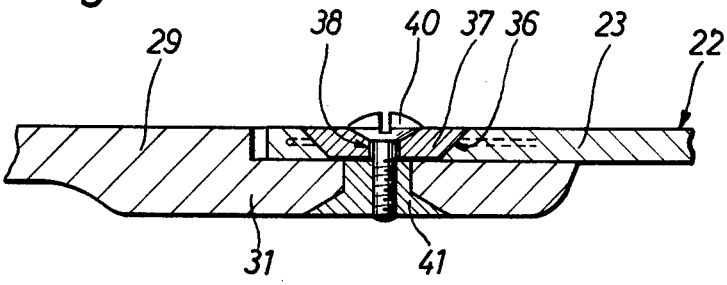
Figure 3A:
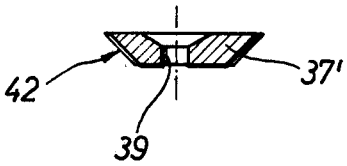
Figure 4:
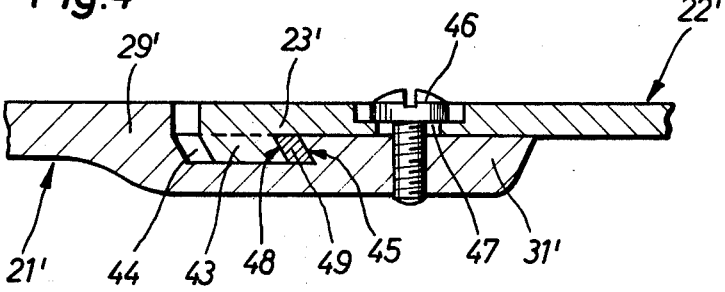

FIGS. 3 and 4 each show a longitudinal section through an alternate embodiment of the invention in the region of a juncture between the cantle plate and the saddle tree frame; and FIG. 3*a* shows a section through an adjusting plate for use with the construction according to FIG. 3.

Figure 1:
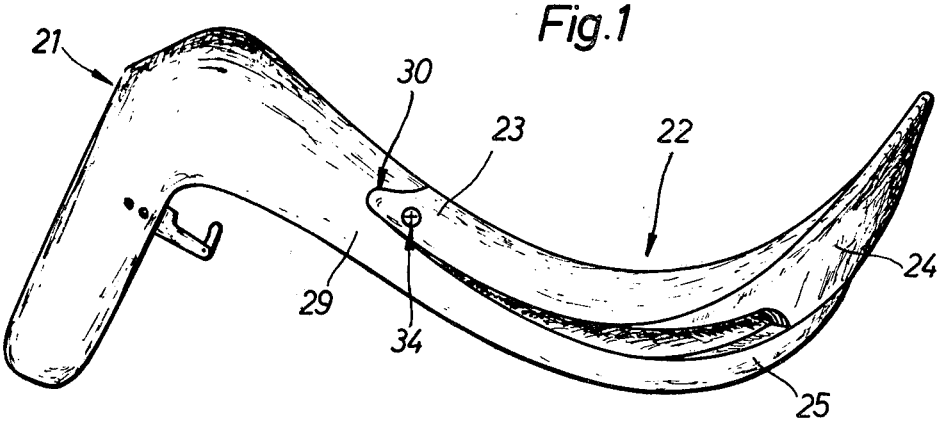
FIG. 1 shows a side view of a saddle tree in accord with the present invention.

Details of saddle tree constructions according to the invention can be seen from the following description of the particularly preferred embodiments shown in FIGS. 1 and 4.

Figure 2:
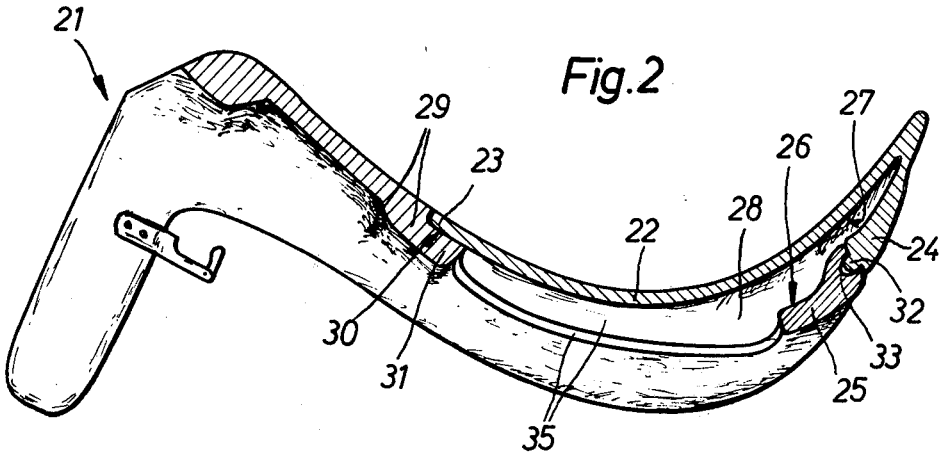
FIG. 2 shows a longitudinal section through the saddle tree according to FIG. 1.

As can be seen from FIGS. 1 and 2, universally applicable saddle tree frame or frame member 21 is equipped with a cantle plate 22 which extends essentially over the entire seat area of the saddle tree (and, therefore, the saddle itself). The cantle plate 22 is joined to the saddle tree frame 21 only at its front peripheral area 23 and at its rear cantle plate edge 24, which rests on the rear edge of the cantle 25 of the saddle tree frame 21. As a result of the shape and the abovementioned disposition of the cantle plate 22, there is a space 28 between the upper side 26 of the saddle tree frame and the under side 27 of the cantle plate 22. This enables the latter to elastically yield or bounce into space 28 when the saddle seat is stressed by the rider seated on it.

The front peripheral area 223 of the cantle plate 22 lies in the vicinity of saddle tree frame waist section 29 in a correspondingly shaped recess 30 of the saddle tree frame 21 which, in area 29, is provided with an appropriate reinforcement 31. The attachment of the cantle plate 22 at its front peripheral area 23 to the saddle free frame 21 may be effected by screws 34.

The rear, reinforced, cantle plate edge 24 is provided with a spring 32 and, to ensure a safe placement and attachment of the cantle plate 22 in the area of the cantle 25 of the saddle tree frame 21, is fitted in a notch 33 disposed in the edge of the cantle 25. No additional fastening is necessary since the cantle plate 22 is attached to the saddle tree frame 21 under a selected initial tension or stress.

The saddle tree frame may, as shown in FIG. 2, have a centrally placed slot 35 underneath the cantle plate 22. Alternatively, it may be closed in this area.

The initial stress desired on the cantle plate 22 can be produced relatively easily by attaching the front peripheral area 23 of the cantle plate 22 to the saddle tree frame 21 in a position which is either further forward or further rearwards in its recess 30. This is accomplished by placing the bore holes for inserting the attaching screws 34 further forward or further back in the reinforced part 31 of the curved, waist section 29.

To render possible an economic series production, however, it is preferred, as shown in FIGS. 3 and 3a, that the cantle plate 22 have, on each side of its front peripheral area 23 and in the same general location as the screws 34 shown in FIG. 1, a conical aperture 36 into which can be inserted a truncated, cone-shaped plug 37 or 37' having either a central bore hole 38 (FIG. 3) or an eccentrically located bore hole 39 (FIG. 3a) to take the attachment screw 40. In the reinforced area 31 of the tree frame waist section 29, there is preferably a screw socket 41 into which the attaching screw 40 can be screwed. The conical periphery of the plugs 37 and 37' may be corrugated to counteract rotation. Depending upon whether a plug as shown in FIG. 3 or FIG. 3a is employed and, if the latter, the spacing of aperture 39 relative to the front and rear edges of the plug, the front edge can be located at one of plural locations relative to saddle tree frame 21.

Another method of attaching the front peripheral area 23 of the cantle plate 22 to the saddle tree frame 21 is shown in FIG. 4. In this, both sides of the cantle plate have, on the underside in the front peripheral area 23 and in the same general location as the screws 34 shown in FIG. 1, a hooklike projection 43 which fits in a groove 44 in the reinforced area 31 of the waist section 29. Groove 44 has a stop forming face 45.

An attachment screw 46 passes through an oblong hole 47 in the outer peripheral area 23 of the cantle plate 22. In the furthest back position of the cantle plate 22, a stop providing face 48 on the hooklike projection 43 lies directly against the stop providing face 45 of the groove 44. If the cantle plate 22 is to be fixed in a further forward position on the saddle tree frame, a separator piece 49 of appropriate thickness is inserted between the two stop faces 45 and 48, positioning the hooked projection 43 further forward.

Through the arrangements just described, it is relatively simple to adjust or even alter the tension of the saddle tree or the initial tension of the springy, elastic, cantle plate.

The above described constructions have made it possible for the first time to produce a plastic saddle tree having the same resilient properties as a conventional spring steel saddle tree and, also, the advantages that it nevertheless lies firmly and securely in its entire length on the horse's back, even during the spring action of the seat, and that it can be economically produced.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A saddle tree which comprises a rigid, front saddle tree member having a neck with points depending therefrom, a waist extending rearwardly from said neck, and mounting means adapted to receive cantles of different lengths and widths so that saddle trees of different sizes can be made using identical front saddle tree members, said mounting means comprising a recess in the upper surface of said front saddle tree member for locating a cantle relative to said front saddle tree member; a separate cantle member seated in said recess, said cantle member having a lower surface portion configured to match said recess and thereby position said cantle member relative to said front saddle member; and means fixing said cantle member to said front saddle tree member, said cantle member being of thin-wall configuration and fabricated of a resilient material and, further, being fixed only at the front and rear portions thereof to said rigid, front saddle tree member and otherwise being spaced from said front saddle tree member so that it can elastically yield in a downward direction into the space between it and said rigid, front saddle tree member.

2. A saddle tree as defined in claim 1 in which the cantle plate spans substantially the entire seat area of the saddle tree.

3. A saddle tree for riding saddles which comprises a rigid saddle tree member having a neck and a waist extending rearwardly from said neck and a separate, resilient cantle plate supported and fixed only at the front and rear portions thereof to said rigid member, said cantle plate otherwise being spaced from said rigid member so that it can elastically yield in a downward direction under the weight of a rider, there being a recess in the waist of the saddle tree member and the front portion of the cantle plate being seated in said recess, said saddle tree further including means fixing the forward portion of the cantle plate in place in said recess and co-operating stops on said saddle tree member and said cantle plate for locating the forward edge portion of the cantle plate relative to the saddle tree member, the stop on the saddle tree member being defined by a wall bounding the recess therein and the stop on the cantle plate being defined by a projection depending from the forward portion thereof.

4. A saddle tree as defined in claim 3 which includes a spacer disposable between said co-operating stops to position the forward portion of the cantle plate at a selected location relative to the saddle tree frame member, whereby the cantle plate can be placed under tensions of selected magnitudes by employing spacers of different thicknesses.

5. A saddle tree for riding saddles which comprises a rigid saddle tree member having a neck and a waist extending rearwardly from said neck and a separate, resilient cantle plate supported and fixed only at the front and rear portions thereof to said rigid member, said cantle plate otherwise being spaced from said rigid member so that it can elastically yield in a downward direction under the weight of a rider, said cantle plate having a downwardly extending, reinforced portion at the rear thereof and a spring member fixed to a lower edge of said downwardly extending portion and there being a recess in the rear of the rigid saddle tree member, said spring member being configured to match, and seated in, said recess to thereby fix the rear portion of the cantle plate to the saddle tree member.

6. A saddle tree for riding saddles which comprises a rigid saddle tree member having a neck and a waist extending rearwardly from said neck and a separate, resilient cantle plate supported and fixed only at the front and rear portions thereof to said rigid member, said cantle plate otherwise being spaced from said rigid member so that it can elastically yield in a downward direction under the weight of a rider, there being a recess in the waist of the saddle tree member and the front portion of the cantle plate being seated in said recess, said saddle tree further including means fixing the forward portion of the cantle plate in place in said recess which includes means for placing said cantle plate under tension of a selected magnitude longitudinally of the saddle to thereby impart a wanted springiness thereto.

7. A saddle tree as defined in claim 6 in which the means for placing said cantle plate under tension comprises means for fixing the front portion of the cantle plate to the rigid saddle tree frame member at different locations longitudinally of the latter whereby said cantle plate can be placed under tensions of different magnitudes.

8. A saddle tree for riding saddles which comprises a rigid saddle tree member having a neck and a waist extending rearwardly from said neck; a separate, resilient cantle plate supported and fixed only at the front and rear portions thereof to said rigid member, said cantle plate otherwise being spaced from said rigid member so that it can elastically yield in a downward direction under the weight of a rider; means for placing said cantle plate under a tension of a selected magnitude to thereby impart a wanted springiness thereto comprising means for fixing the front portion of the cantle plate to the rigid saddle tree member at different locations longitudinally of the latter whereby said cantle plate can be placed under tensions of different magnitudes; and openings on opposite sides of and through the front portion of the cantle tree plate; the means for fixing the front portion of the cantle plate to the saddle tree member comprising apertured members fitted in said openings and fasteners extending through the apertures in said members into the saddle tree member whereby, by employing members with apertures spaced at different distances relative to the front and rear edges thereof, the location of the front edge portion of the cantle plate relative to the rigid saddle tree member can be varied.

* * * * *